US008191607B2

(12) United States Patent
Cho et al.

(10) Patent No.: US 8,191,607 B2
(45) Date of Patent: Jun. 5, 2012

(54) CONTINUOUS CASTING MACHINE USING MOLTEN MOLD FLUX

(75) Inventors: Jung Wook Cho, Pohang-Si (KR); Sang Pil Lee, Pohang-Si (KR); Jae Suk Hong, Pohang-Si (KR); Soon Kyu Lee, Pohang-Si (KR)

(73) Assignee: Posco (KR)

( * ) Notice: Subject to any disclaimer, the term of this patent is extended or adjusted under 35 U.S.C. 154(b) by 254 days.

(21) Appl. No.: 12/306,158

(22) PCT Filed: Jun. 22, 2007

(86) PCT No.: PCT/KR2007/003034

§ 371 (c)(1),
(2), (4) Date: Dec. 22, 2008

(87) PCT Pub. No.: WO2007/148940

PCT Pub. Date: Dec. 27, 2007

(65) Prior Publication Data

US 2009/0277600 A1 Nov. 12, 2009

(30) Foreign Application Priority Data

Jun. 23, 2006 (KR) ..... 10-2006-0056665

(51) Int. Cl.
*B22D 11/00* (2006.01)
*B22D 11/108* (2006.01)

(52) U.S. Cl. ..... 164/415; 164/475; 164/473

(58) Field of Classification Search ..... 164/415, 164/473, 475, 268
See application file for complete search history.

(56) References Cited

U.S. PATENT DOCUMENTS 5,577,545 A 11/1996 Backerud

FOREIGN PATENT DOCUMENTS

| | | |
|---|---|---|
| CN | 2470007 | 1/2002 |
| JP | 49-105727 | 10/1974 |
| JP | 61-154747 | 7/1986 |
| JP | U61-182650 | 11/1986 |
| JP | 63-220952 | 9/1988 |
| JP | 1-202349 | 8/1989 |
| JP | 2-299747 | 12/1990 |
| JP | 3-66459 | 3/1991 |
| JP | 5-23802 | 2/1993 |
| JP | 5-146855 | 6/1993 |
| JP | 5-337614 | 12/1993 |
| JP | 6-7907 | 1/1994 |
| JP | 6-7908 | 1/1994 |
| JP | 6-47511 | 2/1994 |

(Continued)

OTHER PUBLICATIONS

European Extended Search Report for Application No. 07 74 7066 dated Apr. 8, 2010 (8 pages).

(Continued)

*Primary Examiner* — Kevin P Kerns
(74) *Attorney, Agent, or Firm* — Finnegan, Henderson, Farabow, Garrett & Dunner, LLP

(57) ABSTRACT

A continuous casting machine injecting molten mold flux into a mold includes: melt-surface covers covering the upper side of the mold; gas aspirators provided below the melt-surface covers for inhaling the gas in an upper space of the mold; and purge gas injectors provided below the melt-surface covers for injecting purge gas into the upper space of the mold.

20 Claims, 3 Drawing Sheets

FOREIGN PATENT DOCUMENTS

| | | |
|---|---|---|
| JP | 6-79419 | 3/1994 |
| JP | 6-154977 | 6/1994 |
| JP | 6-179055 | 6/1994 |
| JP | 6-226111 | 8/1994 |
| JP | 8-187558 | 7/1996 |
| JP | 8-309489 | 11/1996 |
| JP | 9-85327 | 3/1997 |
| JP | 9-192803 | 7/1997 |
| JP | 2004-9110 | 1/2004 |
| JP | 2004-009110 | 1/2004 |
| JP | 2004-306039 | 11/2004 |
| KR | 10-1998-038065 | 8/1998 |
| KR | 2000-0013468 | 7/2000 |
| KR | 2002-0052622 | 7/2002 |

OTHER PUBLICATIONS

PCT International Search Report for Application No. PCT/KR2007/003034 dated Sep. 21, 2007 (3 pages).

English-language translation of JP 49-105727, 9 pages, Oct. 7, 1974.

English-language translation of JP U61-182650, 10 pages, Nov. 14, 1986.

[Fig. 1]
Prior Art
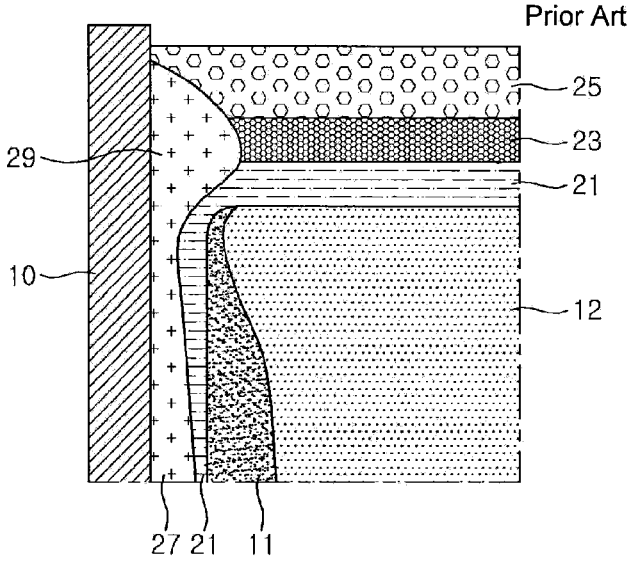
[Fig. 2]
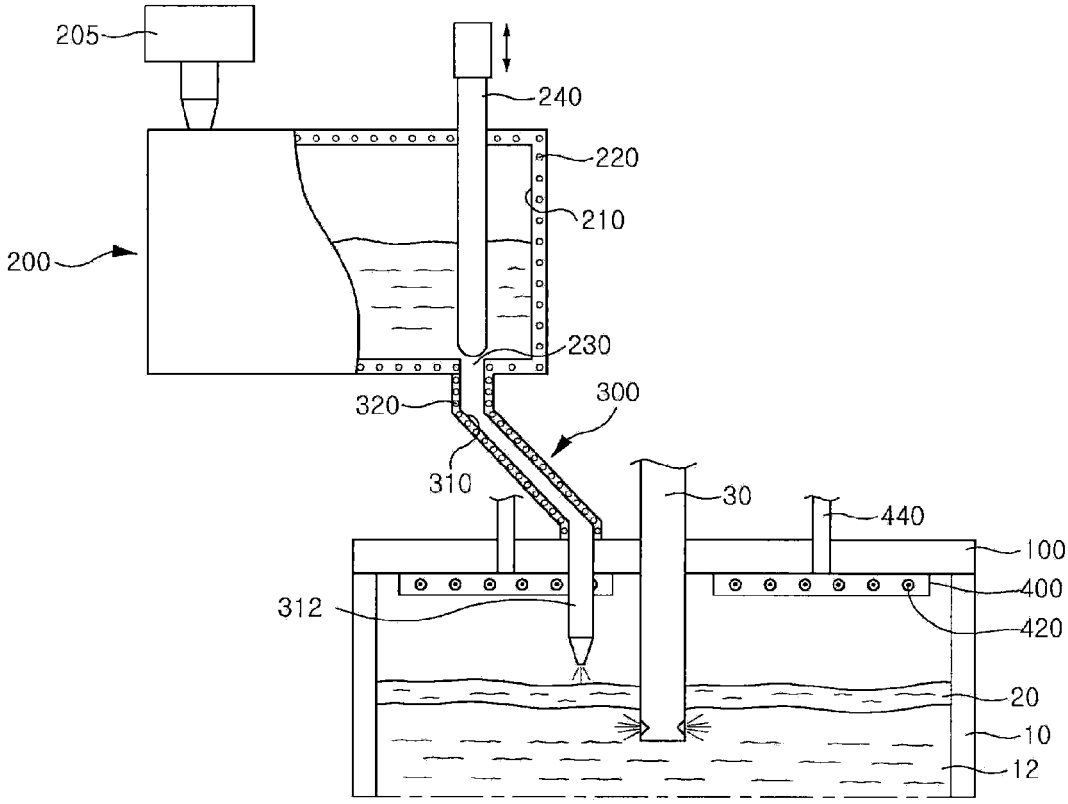

[Fig. 3]
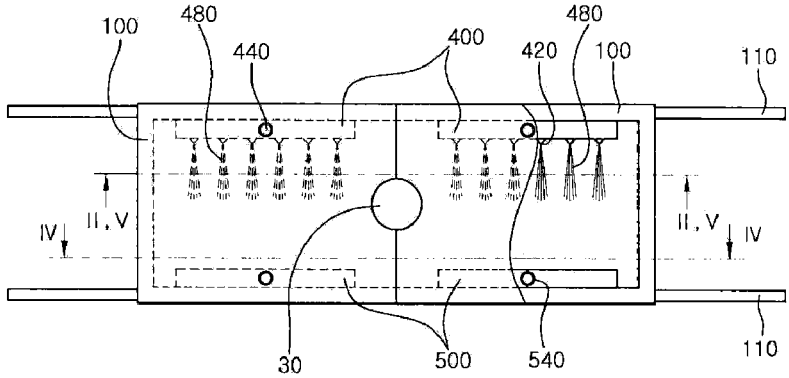
[Fig. 4]
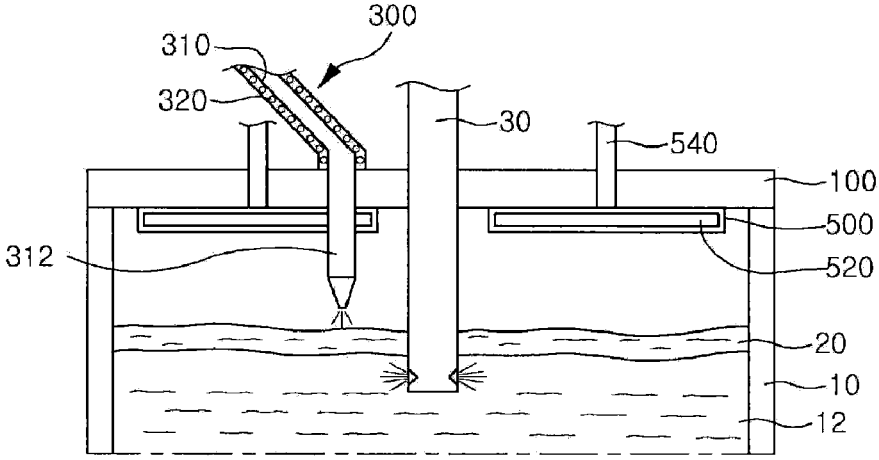
[Fig. 5]
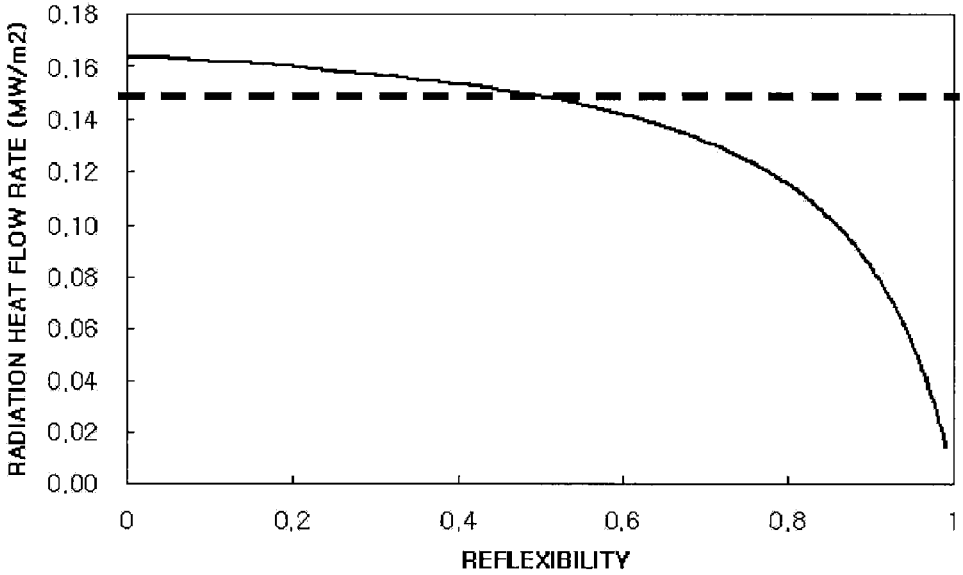

[Fig. 6]
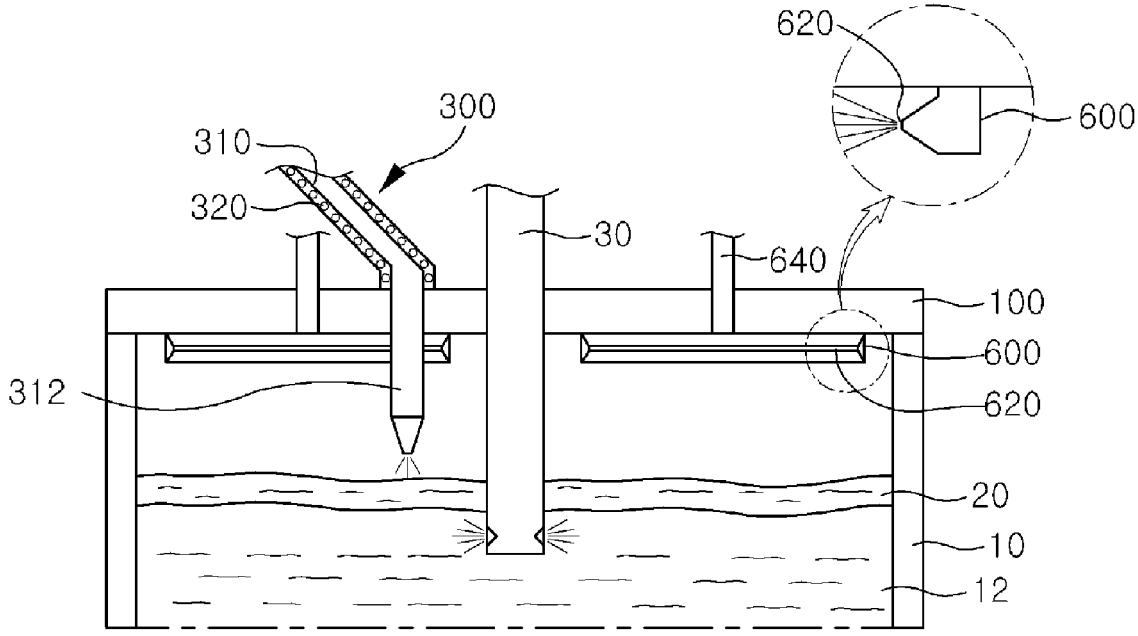

CONTINUOUS CASTING MACHINE USING MOLTEN MOLD FLUX

CROSS REFERENCE TO RELATED APPLICATIONS

This application is a National Phase application based on PCT/KR2007/003034 filed on Jun. 22, 2007, and claims the priority of Korean Application No. 10-2006-0056665, filed Jun. 23, 2006, the content of both of which is incorporated herein by reference.

TECHNICAL FIELD

The present invention relates to a continuous casting machine using molten mold flux, and more particularly, to a continuous casting machine using molten mold flux in which mold flux supplied to the melt-surface in a mold for continuous casting is injected in liquid state throughout the whole continuous casting process by melting the mold flux in advance outside the mold.

BACKGROUND ART

In general, in order to manufacture an as-cast strip (which is a general term for a slab, a billet, a bloom, a beam blank, and the like) by a continuous casting process, molten steel is supplied from a ladle, and then passes through a tundish for storing the molten steel, a submerged nozzle, and a mold. The molten steel is then cooled in a mold by cooling effect thereof, and forms a solidified shell. The solidified shell formed by cooling the molten steel is completely solidified into an as-cast strip by second cooling water that is injected out of the spray nozzles, while being guided by guide rolls disposed under the solidified shell.

During a continuous casting process of steel, when the molten steel is provided into the mold, an additional substance such as mold flux is also added into the mold. Mold flux is generally provided into the mold in a solid state, such as powder or granules, and melted by the heat generated by the molten steel supplied in the mold to control the heat transfer between the molten steel and the mold and improve lubrication.

As shown in FIG. 1, mold flux provided into the mold as granules is melted on the surface of the molten steel 12 and sequentially forms a liquid layer 21, a sintered layer (semi-solid layer) 23, and a powder layer 25 in this order from the melt-surface. The liquid layer 21 easily transmits radiation waves having wavelengths between 500 nm and 4000 nm emitted from the molten steel because it is substantially transparent. The sintered layer 23 and the powder layer 25, however, are optically opaque, so that they prevent a rapid drop in temperature of the melt-surface by blocking the radiation waves.

However, in the related art, after the mold flux in the form of powder or granules is melted by the heat generated by the molten steel, the liquid layer 21 flows between the mold 10 and the solidified shell 11, and then solidified onto the inside wall of the mold 10 to form a solid slag film 27, while a liquid slag film is formed on the molten steel side. Accordingly, the heat transfer between the molten steel and the mold can be controlled and lubrication property is improved.

In this case, the mold flux, which is attached to the mold at a position where the molten slag inflows between the solid slag film 27 and the solidified shell 11, protrudes toward the inside of the mold 10. The mold flux protruding toward the inside of the mold is called a slag bear 29. The slag bear 29 prevents molten slag from flowing between the mold flux film 27 and the solidified shell 11.

The amount of mold flux consumption per unit area of an as-cast strip is suppressed by the slag bear 29. In general, the faster the casting speed increases, the more the mold flux decreases; therefore, lubrication efficiency between the as-cast strip and the mold is decreased and break-out is caused. In addition, since the thickness of liquid mold flux becomes irregular due to the slag bear 29, the shape of the solidified shell 11 becomes irregular in the mold 10 and surface cracks are developed, which gets worse as the casting speed increases.

Korean Unexamined Patent Application Publication No. 1998-038065 and U.S. Pat. No. 5,577,545 disclose methods of restricting the growth of a slag bear by applying graphite or fine carbon black to decrease the melting speed of the mold flux. However, these methods cannot basically prevent a slag bear. In addition, non-uniformity occurs during solidification because non-melted mold flux inflows between the solidified shell and the mold when the melting speed of the mold flux is slow. As a result, the break-out becomes worse.

Methods of injecting mold flux to the melt-surface after melting outside are disclosed in Japanese Unexamined Patent Application Publication Nos. 1989-202349, 1993-023802, 1993-146855, 1994-007907, 1994-007908, 1994-047511, 1994-079419, 1994-154977, and 1994-226111. However, all of the documents above propose restrictively using molten mold flux in an early state of the casting and using powder-typed mold flux after the casting reaches a normal state. Accordingly, it is difficult to maintain the temperature of the surface of molten steel by the methods, since the molten mold flux is substantially transparent for wavelengths between 500 and 4000 nm as described above, so that radiation waves emitted from the molten steel easily pass through the mold flux resulting in increase of the radiation heat transfer. For this reason, after a predetermined time passes in the casting process, the surface of the molten steel is solidified. Therefore, the continuous casting process cannot be smoothly performed.

Further, paper was used to supply molten mold flux into the mold, but it has limitation in supplying molten mold flux throughout the continuous casting process.

DISCLOSURE OF INVENTION

Technical Problem

The invention provides a continuous casting machine that allows injecting molten mold flux into a mold throughout the whole continuous casting process.

Technical Solution

A continuous casting machine according to an embodiment of the invention includes melt-surface covers covering the upper side of the mold, gas aspirators disposed below the melt-surface covers and inhaling the gas in the upper side of the mold, and/or purge gas injectors disposed below the melt-surface covers and injecting purge gas into the upper side of the mold.

Injection nozzles for injecting purge gas of the purge gas injectors and gas inlets for inhaling gas of the gas aspirators may be disposed to face each other.

Purge gas is supplied through a gas pipe into the purge gas injector and a purge gas preheating member may be provided around the purge gas supplying pipe. A flow rate control unit may be installed outside and adjacent to the mold.

Purge gas may be supplied through a gas pipe into the purge gas injector and the purge gas pipe may be provided with flow rate control unit for the purge gas.

The purge gas may include unreactive gas.

The injection nozzles for injecting the purge gas in the purge gas injector may include at least a plurality of needle-typed injection nozzles that are arranged in one line.

The injection nozzles for injecting the purge gas in the purge gas injector may include slit-typed injection nozzles that extend in one direction.

The purge gas injector or the injection nozzles provided in the purge gas injector for injecting the purge gas may be installed movably up/down and rotatory.

The purge gas injected out of the purge gas injector may form a gas curtain under the melt-surface cover.

It is preferable that the purge gas is not injected toward a submerged nozzle inside the mold and the melt-surface.

Gas inlets for inhaling gas in the gas aspirators may extend in one direction.

Advantageous Effects

According to an aspect of the invention, the consumption amount of mold flux is considerably increased because a slag bear is not caused, as compared to the conventional processes, thereby friction between a mold and a solidified shell is reduced. Therefore, oscillation marks and hooks are reduced and the amount of scarfing of an as-cast strip is also considerably reduced. In particular, depth of an oscillation mark is considerably reduced under the condition that oscillation stroke and a negative strip ratio are reduced, as compared with conventional processes.

Further, because pre-carbon is not contained in molten mold flux, carbon pick-up does not take place. Furthermore, it is possible to prevent a variety of crack-type defects on the surface of the as-cast strip, such as longitudinal surface cracks, transverse surface cracks, and corner cracks, by early slow cooling in solidification. In addition, dust is prevented because powder mold flux is not used; therefore, casting environment is improved and the cooling water for continuous casting can be kept from becoming cloudy by unmelted dust.

In particular, the reflexibility of the lower reflective surface of the melt-surface covers is kept constant, so that temperature inside the mold is kept constant even though continuous casting continuously proceeds. Accordingly, continuous casting machine according to an embodiment of the invention can continuously obtain the above effects throughout the entire continuous casting process.

BRIEF DESCRIPTION OF THE DRAWINGS

FIG. 1 is a cross-sectional view of a mold according to a conventional continuous casting process.

FIG. 2 is a cross-sectional view seen from a side of a continuous casting machine according to an embodiment of the invention.

FIG. 3 is a plan view of melt-surface covers of the continuous casting machine according to the embodiment of the invention.

FIG. 4 is a cross-sectional view seen from the other side of the continuous casting machine according to the embodiment of the invention.

FIG. 5 is a graph showing radiation heat flux on the melt-surface in the mold depending on reflexibility of the inside of the melt-surface covers of the continuous casting machine according to the embodiment of the invention.

FIG. 6 is a cross-sectional view seen from a side of the mold of the continuous casting machine to illustrate an exemplary modification of the embodiment of the invention for a nozzle of the continuous casting.

BEST MODE FOR CARRYING OUT THE INVENTION

Preferred embodiments of the invention are now described in detail hereafter with reference to accompanying drawings. The present invention, however, is not limited to the embodiments described herein, but may be modified in a variety of ways, and the embodiments is provided only to fully describe the invention and inform those skilled in the art of the aspects of the invention. The same reference numerals in the drawings refer to the same components.

FIG. 2 is a cross-sectional view seen from a side of a continuous casting machine according to an embodiment of the invention, FIG. 3 is a plan view of melt-surface covers of the continuous casting machine according to the embodiment of the invention, and FIG. 4 is a cross-sectional view seen from the other side of the continuous casting machine according to the embodiment of the invention. In particular, FIGS. 2 and 4 are cross-sectional views taken along lines II-II and IV-IV of FIG. 3, respectively.

Referring to the figures, a continuous casting machine according to an embodiment of the invention includes a mold 10, a submerged nozzle 30 for supplying molten steel into the mold 10, melt-surface covers 100 for covering the upper side of the mold 10, a mold flux melting unit 200 for melting the mold flux to supply into the mold, a mold flux conveying unit 300 for supplying the molten mold flux 20 that is melted in the mold flux melting unit 200 into the mold 10, purge gas injectors 400 installed at a side below the melt-surface covers 100, and gas aspirators 500 installed at the other side below the melt-surface covers 100. In this configuration, the mold 10 and the submerged nozzle 30 are the same as in a conventional continuous casting machines and not described herein.

The melt-surface covers 100 is disposed on the mold 10 and covers the entire melt-surface to prevent radiation waves emitted from the surface of the molten steel 12 from traveling outside. As shown in detail in FIG. 3, the melt-surface covers 100 includes a pair of right and left covers. The pair of right and left covers are mounted on a pair of guide rails 110 disposed parallel with each other on the mold 10 such that they can slide to the right and left, respectively. Specifically, the melt-surface covers 100 close the upper side of the mold 10 by sliding such that the facing sides contact to each other, and open the upper side of the mold 10 by sliding away from each other. Semicircular cuts are formed at the facing sides of the melt-surface covers 100. When the melt-surface covers 100 close the upper side of the mold 10, the cuts form a through-hole such that the submerged nozzle 30 can pass through. Therefore, the submerged nozzle 30 is disposed in the mold 10 through the melt-surface cover 100.

The insides, i.e. lower surfaces of the melt-surface covers 100 facing the molten steel are made of a material having high reflexibility, such as an aluminum mirror or a gold-coated mirror, so that they reflect radiation waves emitted from the surface of the molten steel 12 and the reflected radiation waves are absorbed back into the molten mold flux 20 or the surface of the molten steel 12. Accordingly, a drop in the surface temperature of the molten steel 12 is minimized, and the molten mold flux 20 is prevented from being re-solidified on the surface of the mold 10.

According to the continuous casting machine having the above configuration, as the molten steel and molten mold flux are injected into the mold 10, the molten mold flux 20 volatilizes or evaporates, and the evaporated substance is adhered to the inside, i.e. the lower reflective surface of the melt-surface covers 100 during the continuous casting process. In general, while molten mold flux is transmissive, the evaporated substance from the molten mold flux adhered to the lower reflective surface of the melt-surface covers 100 is opaque, so that the reflexibility of the lower reflective surface of the melt-surface covers 100 is reduced.

Therefore, in the continuous casting machine according to the embodiment of the invention, the purge gas injectors 400 and the gas aspirators 500 are respectively provided at both sides below the melt-surface covers 100 facing each other, and remove the evaporated molten mold flux 20 to improve reflexibility of the lower reflective surface of the melt-surface covers 100. In detail, the purge gas injector 400 extends in the sliding direction of the melt-surface cover 100 and is disposed at a side below each of the melt-surface covers 100. A plurality of needle-typed purge gas injection nozzles 420 are formed at predetermined intervals in a row (or a plurality of rows) in the sliding direction of the melt-surface cover 100 in the purge gas injector 400. A purge gas supplying pipe 440 extending to the outside the mold 10 through the melt-surface cover 100 is connected to the upper side of the purge gas injector 400. The purge gas supplying pipe 440 is connected to a purge gas supplier (not shown) outside the mold 10, so that purge gas 480 is supplied through the purge gas supplying pipe 440 into the purge gas injector 400 and then injected out of the purge gas injection nozzles 420 from one side to the other side under the melt-surface cover 100. The injected purge gas 480 blows out the evaporated molten mold flux 20 to prevent adhesion to the lower reflective surface of the melt-surface covers 100.

The purge gas 480 may be injected in parallel with the lower reflective surface under the melt-surface cover 100 to form air curtains, but it is not limited thereto. For example, the purge gas injector 400 or the purge gas injection nozzle 420 in the injector is installed movably up/down and/or rotatably, so that they can uniformly inject the purge gas to the entire lower reflective surface of the melt-surface cover 100 while moving up/down and rotating. However, it may not preferable that the purge gas 480 is injected to the submerged nozzle 30 or the surface of the molten mold flux 20. The temperature of the injected purge gas 480 is lower than that of the upper space of the mold 10, particularly the surface of the submerged nozzle 30 or the molten mold flux 20. Accordingly, the purge gas 480 may change the properties of the molten steel in the submerged nozzle 30 or the molten mold flux 20. The purge gas 480 used in this embodiment is inert gas, such as argon, or unreactive gas, such as nitrogen, not to react with the molten mold flux 20 in the mold 10.

On the other hand, a heating wire (not shown), a purge gas pre-heating member, may be provided around the purge gas supplying pipe 440 to reduce a temperature difference between the upper side of the mold 10 and the purge gas 480 injected into the upper side of the mold 10. The heating wire may be disposed right above and adjacent to the melt-surface cover 100. Further, it is needed to control the amount of the purge gas 480 injected into the upper surface of the mold 10 depending on the amount of the evaporated substance from the molten mold flux 20; therefore, a valve (not shown), as a flow rate control unit, may be further provided to the purge gas supplying pipe 440.

Further, at the other sides of the melt-surface covers 100 facing the purge gas injectors 400, the gas aspirators 500, similar to the purge gas injector 400, are also installed below melt-surface covers 100 such that they extend in the sliding direction of the melt-surface covers 100. A gas inlet 520 is formed in the gas aspirators 500 to be opened facing the purge gas injection nozzles 420 of the purge gas injectors 400. In each gas aspirator 500, one gas inlet 520 may be formed extending in the sliding direction of the melt-surface cover 100, but it is not limited thereto. A gas intake pipe 540 extending to the outside the mold 10 through the melt-surface covers 100 is connected to the upper side of the purge gas aspirator 500. Further, the gas intake pipe 540 is connected to a vacuum pump (not shown) outside the mold 10, and inhales the gas in the upper space of the mold 10, such as the purge gas 480 and the evaporated substance from the molten mold flux 20.

The purge gas injectors 400 maintain a predetermined reflexibility of the lower reflective surface of the melt-surface cover 100 by injecting the purge gas 480 into the upper space of the mold 10 to prevent the evaporated substance from the molten mold flux 20 from adhering to the lower reflective surface of the melt-surface cover 100. Further, the gas aspirators 500 maintain a predetermined reflexibility of the lower reflective surface of the melt-surface cover 100 by inhaling the evaporated substance from the molten mold flux 20. Accordingly, in this embodiment, the purge gas injector 400 and the gas aspirator 500 are disposed at both sides of the melt-surface cover 100 facing each other, but one of the purge gas injector 400 and the gas aspirator 500 may be disposed at one side or both sides. The mold is not completely closed by the surface covers 100. Even when only the purge gas injector 400 is provided, the injected purge gas 480 can leak out of the mold 10 with evaporated material from the molten mold flux 20 through openings: between the melt-surface covers 100 and mold 10; and the melt-surface covers 100 and submerged nozzle 30.

The mold flux melting unit 200 includes: a mold flux supplier 205; a crucible 210 containing raw material for the mold flux that is in liquid state temporarily melted by the mold flux supplier 205, or in powder or granules state; a mold flux heating member 220, such as a heating wire provided around the crucible 210 to melt the mold flux; an outlet 230 for discharging the molten mold flux that is melted in a desired state in the crucible 210; and a stopper 240 for controlling the amount of the molten mold flux discharged by opening/closing the outlet 230. The stopper 240 controls the amount of discharged molten mold flux by adjusting the distance between the lower end of the stopper 240 and the edge of the outlet 230 while reciprocating up and down above the outlet 230. The reciprocation of the stopper 240 is accurately controlled by a hydraulic or pneumatic cylinder (not shown).

The conveying unit 300 includes: an injection pipe 310 with an end connected to the mold flux melting unit 200, and the other end is provided with an injection nozzle 312 supplying the molten mold flux 20 into the mold through the melt-surface covers 100; and an injection pipe heating member 320, such as a heating wire that is provided around the injection pipe 310 and heats the injection pipe 310 between the mold flux melting unit 200 and the melt-surface covers 100. The injection pipe 310 and the outside of the injection pipe heating member 320 may be insulated with a heat insulating material to keep the molten mold flux 20 at a predetermined temperature.

In the above configuration, the melt-surface covers 100 are necessary to perform the continuous casting using molten mold flux throughout the process. When the radiation heat flow is more than about 0.15 $MW/m^2$, it can be seen that heat loss on the melt-surface in a case where the molten mold flux 20 is injected into the mold is larger than that in a case where the conventional powder mold flux is used. Referring to FIG. 5 showing changes in radiation heat flow rate according to reflexibility based on the above-mentioned characteristic, it can bee seen that the heat loss becomes larger compared to a process using the conventional powder mold flux when the ratio of reflexibility to the radiation is less than 50%. Therefore, the inside, i.e. the surface facing the molten steel of the melt-surface cover 100 is made of a material having good reflexibility to the molten steel radiation, such as aluminum, copper, or gold, with appropriate surface roughness for the inside reflexibility of more than 50%. That is, the average reflexibility of the inside of the melt-surface cover 100 is kept above 50% for the infrared light within a range of 500 to 4000 nm, so that the melt-surface temperature is preserved during casting to smoothly perform the molten mold flux process throughout.

The content of carbon, such as graphite or carbon black (hereinafter, graphite or carbon black is referred to as pre-carbon to distinguish them from carbon in carbonate type), in the mold flux provided in the crucible 210 is limited to 1 wt % or less, because pre-carbon is not needed during casting according to the embodiment of the present invention. In a conventional process using powder mold flux, pre-carbon of 1 wt % or more is required to prevent a slag bear. According to the embodiment of the invention, molten mold flux is used and the slag bear is not formed. Accordingly it is not necessary to add pre-carbon. No pre-carbon may be added in the mold flux. However, even though pre-carbon of 1 wt % or less is included as an impurity, it is oxidized and removed as a gas during melting of the mold flux. Therefore, molten mold flux contains no pre-carbon.

The whole body or a part of the mold flux melting unit 200 and the conveying unit 300 are made of platinum or a platinum alloy such as platinum-rhodium (Pt—Rh). The mold flux has low viscosity to rapidly melt nonmetallic inclusions floating on the melt-surface of the mold during casting. The mold flux rapidly melts oxidized substances, such as $Al_2O_3$. Therefore, corrosion by the molten mold flux 20 rapidly proceeds in a refractory furnace used in a conventional glass industry. In particular, when corrosion develops at the outlet 230 through which the molten mold flux 20 is discharged out of the mold flux melting unit 200, the lower end of the stopper 240 or at the injection pipe 310 including the injection nozzle of 312 of the mold flux conveying unit 300, accurate control of a flow rate of the molten mold flux becomes difficult and stability in continuous casting can not be ensured. Therefore, at least the injection pipe 310 and the connecting and contacting portions to the pipe, i.e. the outlet 230 through which molten mold flux is discharged, the stopper 240, and the injection pipe 310, may be made of platinum or a platinum alloy to prevent corrosion by the mold flux. Other than platinum or platinum alloys, graphite or nickel-based alloys having high heat-resistance are known as materials that are not corroded by molten mold flux, but they are difficult to withstand high temperatures above 1300 C for a long time and not suitable for continuous casting.

Further, the flow rate of the molten mold flux in the above configuration depends on the amount of molten steel that is provided into the mold per unit of time, and when the amount of molten steel provided is in the range of 1 to 5 ton/min, the supplied amount of molten mold flux is in the range of 0.5 to 5 kg/min. Therefore, it is required to accurately control the above low flow rate to continuously inject the molten mold flux 20 throughout continuous casting. Molten mold flux was injected by tilting furnace type or a siphon type using pressure difference in the related art. However, these types are not suitable for accurate control of flow rate of molten mold flux within 0.5 to 5 kg/min, although being useful to inject large amount of mold flux to the melt-surface. In particular, it is difficult to find out thickness of the mold flux covering the melt surface and instantaneously control the flow rate while observing the melt-surface. According to an embodiment of the invention, it is possible to accurately control low flow rate of the molten mold flux 20 by actuating the stopper 240 up and down to control the space between the lower end of the stopper 240 and the edge of the outlet 230 as shown in FIG. 2. However, the flow rate of the molten mold flux 20 may be controlled by a sliding gate instead of the stopper 240 shown in FIG. 2.

The conveying unit 300 is supposed to keep the molten mold flux 20 at a constant temperature, when the molten mold flux 20 is provided from the mold flux melting unit 200 into the mold 10. Therefore, the heating member 320, such as heating wires, is provided around the injection pipe 310 of the conveying unit 300.

Temperature of the molten mold flux provided into the mold is required to be maintained below the liquidus temperature of the molten steel by 100 C to 300 C. When the temperature of the molten mold flux is lower than the above temperature range, temperature of the molten steel instantaneously drops and the surface may be solidified. When the temperature of the molten mold flux is higher than the above temperature range, solidification of the molten steel may be considerably delayed at the side of the mold. For example, for a typical extra-low carbon steel including 60 ppm of carbon and having a liquidus temperature of 1530, temperature of molten mold flux should be in a range of 1230 C to 1430 C.

Accordingly, the injection pipe heating member 320 is required to keep the temperature of the molten mold flux below the liquidus temperature of the molten steel by 100 C to 300 C, while the molten mold flux 20 flows through the conveying unit 300. Thus, excessive cooling of the molten steel or solidification delay of the molten steel at the side of the mold can be prevented, when the molten mold flux is provided on the melt-surface. In addition, the molten mold flux can be injected into the mold under accurate control of low flow rate of 0.5 to 5 kg/min during continuous casting by maintaining viscosity and preventing cooling or partial solidification of the molten mold flux.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

For example, the purge gas injectors 400 and the gas aspirators 500 are installed to the melt-surface covers 100 in the above embodiments, but may be installed on the mold 10.

Further, the purge gas injectors 400 having several needle-typed gas injection nozzles 420 are employed in the above embodiments shown in FIGS. 2 and 3, but, as shown in FIG. 5, purge gas injectors 600 having slit-typed purge gas injection nozzles 620 may be employed. The purge gas injection nozzle 620 seen from the side is shown inside a circle in FIG. 6. The purge gas injector 600 is supplied with purge gas through a purge gas supplying pipe 640 connected to the gas supplier, and injects the purge gas to the upper space of the mold 10 using the purge gas injection nozzles 620.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A continuous casting machine injecting mold flux in a molten state into a mold, comprising:

melt-surface covers disposed on the mold to cover the entire melt-surface, wherein the melt-surface covers include a pair of right and left covers which can slide to the right and left, respectively; and gas aspirators formed to extend in a sliding direction of the melt-surface covers and installed below the melt-surface covers to inhale gas in an upper space of the mold.

2. The continuous casting machine of claim 1, further comprising:

purge gas injectors installed below the melt-surface covers to inject purge gas into the upper space of the mold.

3. The continuous casting machine of claim 2, wherein injection nozzles of the purge gas injectors to inject purge gas and gas inlets of the gas aspirators to inhale gas are disposed to face each other.

4. The continuous casting machine of claim 2, wherein the purge gas is supplied through a gas pipe into the purge gas injector and a purge gas preheating member is provided around the purge gas supplying pipe.

5. The continuous casting machine of claim 2, wherein the purge gas is supplied through a gas pipe into the purge gas injector and the purge gas pipe is provided with a flow rate control unit for the purge gas.

6. The continuous casting machine of claim 2, wherein the purge gas includes unreactive gas.

7. The continuous casting machine of claim 2, wherein injection nozzles to inject the purge gas in the purge gas injector include at least a plurality of needle-typed injection nozzles that are arranged in one line.

8. The continuous casting machine of claim 2, wherein injection nozzles to inject the purge gas in the purge gas injector include slit-typed injection nozzles that are disposed extending in one direction.

9. The continuous casting machine of claim 2, wherein the purge gas injector or injection nozzles provided in the purge gas injector to inject the purge gas is installed movably up/down and rotatory.

10. The continuous casting machine of claim 2, wherein the purge gas injected out of the purge gas injector forms a gas curtain under the melt-surface cover.

11. The continuous casting machine of claim 2, wherein the purge gas is not injected toward a submerged nozzle disposed in the mold and the melt-surface.

12. A continuous casting machine injecting mold flux in a molten state into a mold, comprising:

melt-surface covers disposed on the mold to cover the entire melt-surface, wherein the melt-surface covers include a pair of right and left covers which can slide to the right and left, respectively; and purge gas injectors formed to extend in a sliding direction of the melt-surface covers and installed below the melt-surface covers to inject purge gas into an upper space of the mold.

13. The continuous casting machine of claim 12, wherein the purge gas is supplied through a gas pipe into the purge gas injector and a purge gas preheating member is provided around the purge gas supplying pipe.

14. The continuous casting machine of claim 12, wherein the purge gas is supplied through a gas pipe into the purge gas injector and the purge gas pipe is provided with a flow rate control unit for the purge gas.

15. The continuous casting machine of claim 12, wherein the purge gas includes unreactive gas.

16. The continuous casting machine of claim 12, wherein injection nozzles to inject the purge gas in the purge gas injector include at least a plurality of needle-typed injection nozzles that are arranged in one line.

17. The continuous casting machine of claim 12, wherein injection nozzles to inject the purge gas in the purge gas injector include slit-typed injection nozzles that are disposed extending in one direction.

18. The continuous casting machine of claim 12, wherein the purge gas injector or injection nozzles provided in the purge gas injector to inject the purge gas is installed movably up/down and rotatory.

19. The continuous casting machine of claim 12, wherein the purge gas injected out of the purge gas injector forms a gas curtain under the melt-surface cover.

20. The continuous casting machine of claim 12, wherein the purge gas is not injected toward a submerged nozzle disposed in the mold and the melt-surface.

* * * * *